US005769713A

United States Patent [19]

Katayama

[11] Patent Number: 5,769,713

[45] Date of Patent: Jun. 23, 1998

[54] DATA PROCESSING APPARATUS FOR BASEBALL GAME

[76] Inventor: Muneomi Katayama, 1-12 Wakaba, Shinjuku-ku, Tokyo, Japan

[21] Appl. No.: 566,849

[22] Filed: Dec. 4, 1995

[51] Int. Cl.[6] ..... A63F 9/00

[52] U.S. Cl. ..... 463/3

[58] Field of Search ..... 463/1, 2, 3, 4, 463/36, 37, 38, 43, 44

[56] References Cited

U.S. PATENT DOCUMENTS

| | | | |
|---|---|---|---|
| 4,372,557 | 2/1983 | Del Principe et al. | 463/3 |
| 4,672,541 | 6/1987 | Bromley et al. | 463/3 |
| 4,695,953 | 9/1987 | Blair et al. | 463/3 |

*Primary Examiner*—George Manuel
*Attorney, Agent, or Firm*—Hazel & Thomas

[57] ABSTRACT

The present invention makes it possible to input, process, modify and edit necessary information such as character, diagram or image information, and display that information on a display in a computer. The present invention incorporates a monitor display A, a personal computer B for processing, storing and controlling data to be inputted, a handy-sized touch pen board D for inputting the processing information, one or more video cassette records connected to the personal computer B through a converter E for converting signals from the personal computer B into image signals, one or more controllers G building into a video cassette recorder F for displaying a desired image on a display as still or dynamic images, and a video cassette recording H to be connected with the personal computer B, for storing a video image which is edited in the controller G. The monitor display and/or touch pen board D has a menu screen I, which comprises a diamond table, strike zone table 2, score board diagram 3, and count indicator for indicating strikes, ball, and outs.

21 Claims, 21 Drawing Sheets

| BATTER/PITCHER | XXXX | XXXX | XXXX | XXXX |
|---|---|---|---|---|
| OOOO | 3-1 | 1-2 | 0-0 | 0-3 |
| OOOO | 3-3 | 1-2 | 0-0 | 0-3 |
| OOOO | 3-3 | 1-1 | 0-0 | 0-3 |
| OOOO | 2-3 | 1-3 | 0-0 | 0-3 |
| OOOO | 2-3 | 2-3 | 0-0 | 0-3 |
| OOOO | 2-3 | 1-3 | 1-1 | 0-3 |
| OOOO | 1-3 | 1-3 | 0-2 | 1-3 |
| OOOO | 1-3 | 3-3 | 0-3 | 0-3 |
| OOOO | 1-3 | 1-3 | 0-2 | 0-3 |
| OOOO | 2-3 | 1-3 | 0-3 | 0-3 |
| OOOO | 2-3 | 3-3 | 0-3 | 1-3 |

FIG. 19

DATA PROCESSING APPARATUS FOR BASEBALL GAME

FIELD OF THE INVENTION

This invention relates to a data processing apparatus for baseball games for inputting collectible data from a baseball game in progress, processing the data and displaying the collected data in the form of characters, diagrams, stills or dynamic pictures on a computer display.

BACKGROUND OF THE INVENTION

Conventionally, it was normal to fill all the baseball game data in a data sheet made of paper, so-called baseball game scorebook, and to record the baseball game data while the game was in progress. Unfortunately, it was not possible to extract desired information instantly in a usable form when it is needed.

For example, if it is possible for a team scorer or pitcher to know the kind of pitch a particular batter can use to hit a home run, then he can gain a considerable advantage over that batter if and when the pitcher confronts the batter in a future game.

On the other hand, if it is possible for a batter to know the strongest pitches of a particular pitcher and study the pitcher's pitching motion in the form of still pictures or videos, that batter can then gain an advantage over that pitcher.

According to this invention, desired data that is generated in the progress of a baseball game can be inputted as a database of information, processed, modified and edited. The data can then be outputted or displayed in the form of characters, diagrams, and still or dynamic pictures.

SUMMARY OF THE INVENTION

The data processing apparatus for a baseball game of this invention has a monitor display A, a personal computer B for processing, storing and controlling input data, a handy-sized touch pen board D for inputting the processed information into the personal computer, a converter E for converting a signal, input from said computer into a picture symbol, one or more than one video cassette recorder F, combined with the personal computer B through the converter E, a controller G for displaying a desired picture in the form of still or dynamic pictures and a video cassette recorder H connected to the personal computer and for storing a video picture as edited by said controller G.

Furthermore, an initial screen on said monitor display and touch pen board displays at least diamond table 1, strike zone table 2, score board table 3, and a count indicator 4 for indicating a strike, ball or out.

Therefore, a team scorer will bring the touch pen board D instead of a baseball game scorebook, and the video cassette recorder F when he goes to a baseball stadium. When the scorer goes to the baseball stadium in which a televised game is in progress, he will record the broadcast of the game or input the desired data on the screen which displays the touch pen board D with the broadcast. However, it is necessary for this invention that the team scorer goes to the baseball stadium because he must decide the kind of pitch, for example, a straight, curve, slider, screw, or fork ball the pitcher threw, and also collect data on the batter(s).

A team scorer switches on the touch pen board D and the video cassette recorder linked with the touch pen board D when a game starts, and then inputs data on every movement of the pitcher(s) and batter(s).

The team scorer inputs the data on the strike or ball through the touch pen C and then inputs data on the kind of pitch and ball distribution. The inputted data is then displayed in a strike zone table 2. At that point, the team scorer inputs a predetermined time by conventional means. However, current video cassette recorders have timekeeping functions such that time data can be inputted automatically from the video cassette record H.

As a result, the inputted data is displayed in the same plane of the strike zone table 2 while a batter is at bat. Therefore, the team scorer will input all the desired data by checking up the input data on the monitor display A.

If the batter gets a hit, the team scorer will click a hit key. Preferably, when the scorer clicks on a distribution diagram of the batted ball and on bases to where a base runner advances, on the diamond table 1, the batted ball line and base running line may be drawn on the diamond table 1 automatically. This makes the inputting of the desired data easy and interesting to the team scorer.

When an out count indicator 4 counts three outs, the inning score will be indicated in the score board table 3, the inputting of data in the inning will be completed and stored. Data will then be repeatedly inputted for each inning until the game finishes.

Then, after the team scorer inputs all the game data via the touch pen board D, he can bring the touch pen board D and the video cassette recorder F home or to another place to connect them with the personal computer B. The data, stored in the touch pen board D, is transferred into the personal computer B. Therefore, the data need not be stored in the memory of the touch pend board when the data is processed, modified and edited.

This invention is characterized in at least providing a character indicator 5 for indicating the kind of pitch thrown by a pitcher on the initial screen I of the monitor display A.

That is, the team scorer or batter can study the pitcher's pitching combination and motion during the baseball game by looking at the kinds of pitches, such as straight, fork or sinker, thrown by the pitcher and indicated in the form of diagrams, bar graphs or time progressive diagrams on monitor display A.

Furthermore, this invention is characterized in providing a numerical indicator for an integer of 0 to 9 to represent the speed of a ball thrown by a pitcher. Therefore, the pitcher's allocation for the ball speed can be expected or anticipated.

In addition, this invention is characterized in providing a menu screen for processing, modifying and editing the input data.

According to the invention, the monitor display A displays the initial screen I and the menu screen II. The menu screen II has character indicators or keys, as well as at least a score table L, a picture M, a ball distributing pattern N, and a batted ball pattern 0. When the score table L is clicked, a data block with the names of the pitcher and batters who have come against the pitcher with numbers of strike out counts and the resulting hit by the batter is displayed for each turn a batter comes to bat. Therefore, the team scorer will know all the game data at necessary places on the same screen, and can access important information for analyzing the game or for using as a reference for future games.

Furthermore, according to this invention, circular and bar graphs can be displayed for indicating the rate at which different kinds of pitches, i.e., straight, curve, fork, etc., are thrown by a pitcher. When a hit table is accessed for indicating a specific combination of pitcher and batter, as designated by the team scorer, the team scorer can know what kind of ball a batter prefers or can hit.

Next, the automatic picture editor system comprises a monitor display A, a personal computer B for processing data to be inputted, a converter or V-box E connected to the personal computer B, a reproducing video deck "a" connected to the converter E through an AV table, and a recording video deck connected to the converter E through the rank cable, the video deck "a", and the personal computer B.

Accordingly, if the team scorer or a batter would like to look at a pitcher's pitching form, he would operate a tape in the reproducing video deck "a", and enable it to output inputted picture(s) of the pitcher to the monitor display A after the input data is edited through the personal computer or recorded into the recording video deck.

BRIEF DESCRIPTION OF THE DRAWINGS

FIG. 19 is an explanatory view of a hit table to be displayed on a display.

Figure 1:
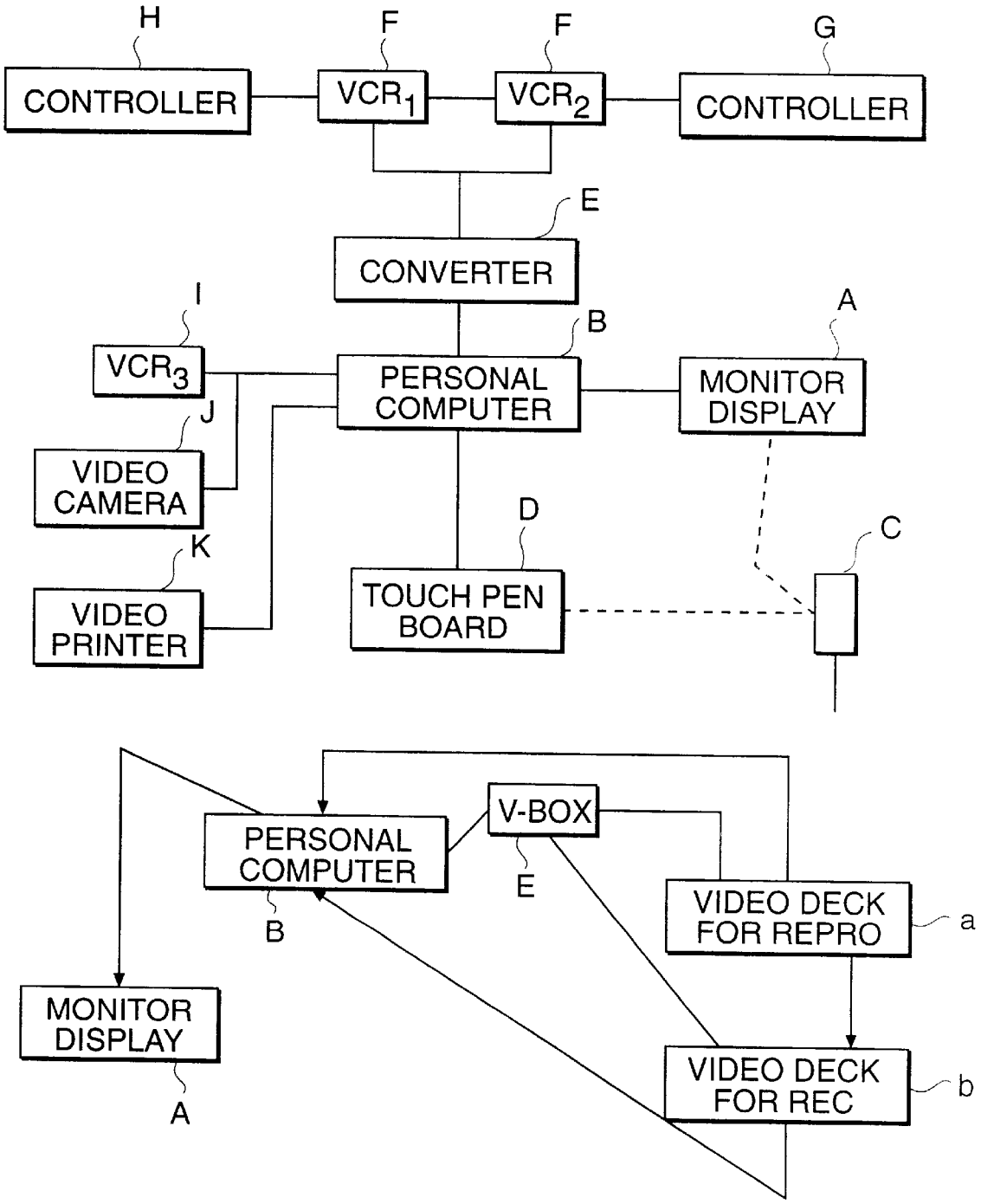
FIG. 1 shows a block diagram of a computer system to be used in the preferred embodiment of this invention.

Numeral references in the figures designate a monitor display A, a personal computer B, a touch pen C, a touch pen board D, a converter E, a video cassette recorder F, a controller G, a score table L, an image M, a ball distribution pattern N, a batted ball pattern 0, a hit table P, a ball distribution pattern for right and left handed batters Q, a career matching between a batter and pitcher R, a diamond table 1, a strike zone table 2, a score board table 3, a character indicator for a kind of ball 5, and a number indicator 6.

DETAILED DESCRIPTION OF THE EMBODIMENTS

FIG. 1 shows a block diagram of the preferred embodiments for implementing this invention, A being a computer monitor display, B being a personal computer for storing in memory, controlling and processing information inputted through the computer monitor display. In the embodiment, a PC-9801FA made by the Japanese corporation, NEC Corp., is used. However, the personal computer B is not limited to using a PC-9801FA.

The personal computer B is operated by a touch pen C, functioning through a touch pen board D, or a computer display A directly.

A converter E for converting signals transmitted from the personal computer B is provided in one or more video cassette recorders F, and connected with the personal computer B.

The video cassette recorders F perform the reproduction of output images transmitted from the personal computer B. In this embodiment, two units of Model No. EVO-9650 for Hi-8 made by the Japanese corporation, SONY Corp., are used. However, the video cassette recorders F are not limited to EVO-9650 models. The controllers G and H connected to respective video cassette recorders F detect desired images and control the personal computer B to display still or dynamic images on the monitor display.

A necessary image may be printed on a hard copy through a video printer K.

Figure 2:
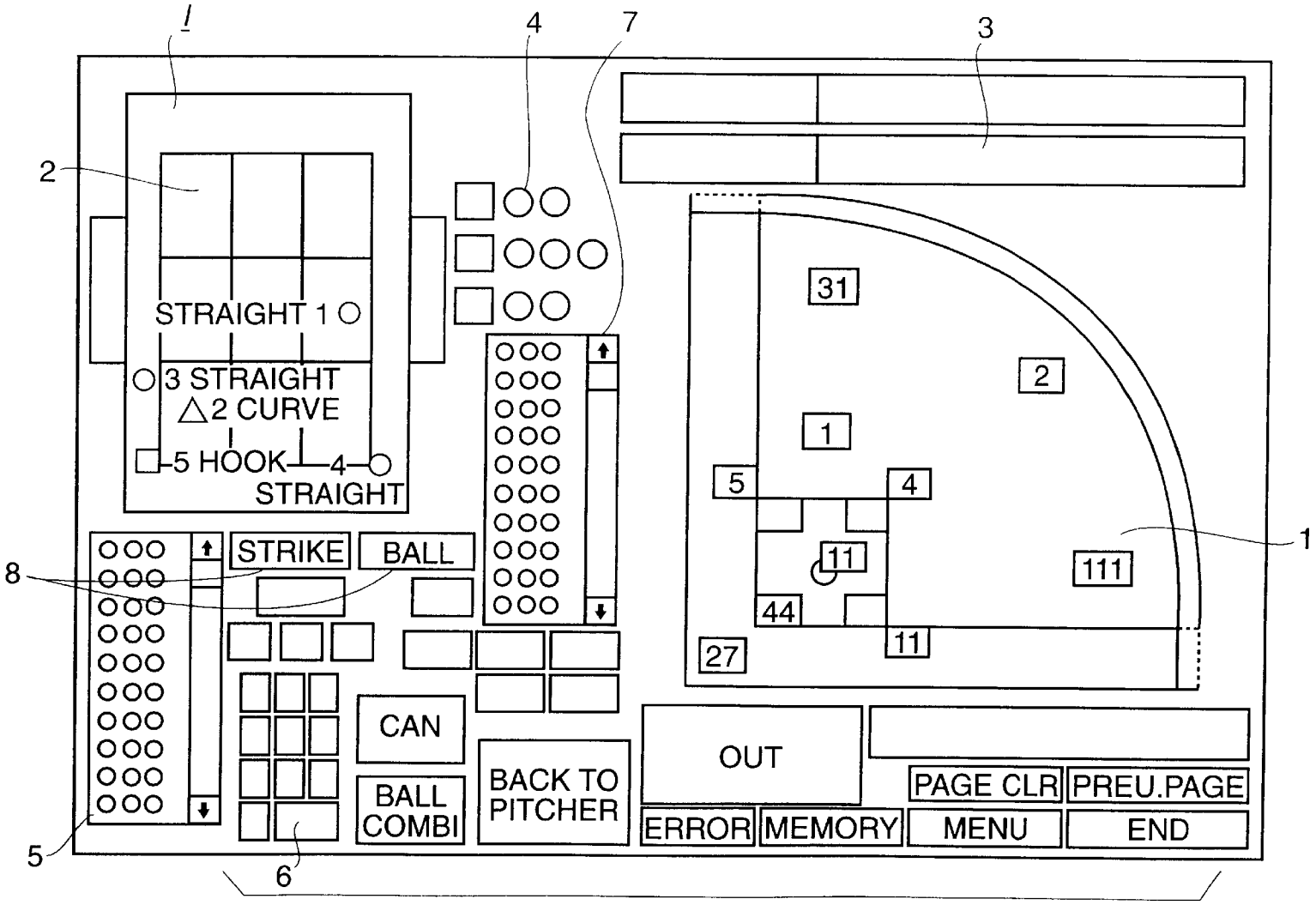
FIG. 2 shows a view of menu screen I to be displayed on a monitor display.

FIG. 2 shows a layout example of an initial screen for inputting baseball data, 1 being a diamond table at the center right, 2 being a strike zone table at the upper left, 3 being a scoreboard table at the upper side of the diamond table 1, 4 being a strike, ball or out count indicator between the diamond table 1 and the strike zone table 2, and 7 being a character indicator for indicating the batting result of a batter.

Furthermore, a ball indicator 5 for indicating the kind of pitch thrown by a pitcher, a character indicator 8 for indicating a strike or ball and a numerical indicator of 0 to 9 for inputting a ball speed thrown by a pitcher are provided.

Figure 3:
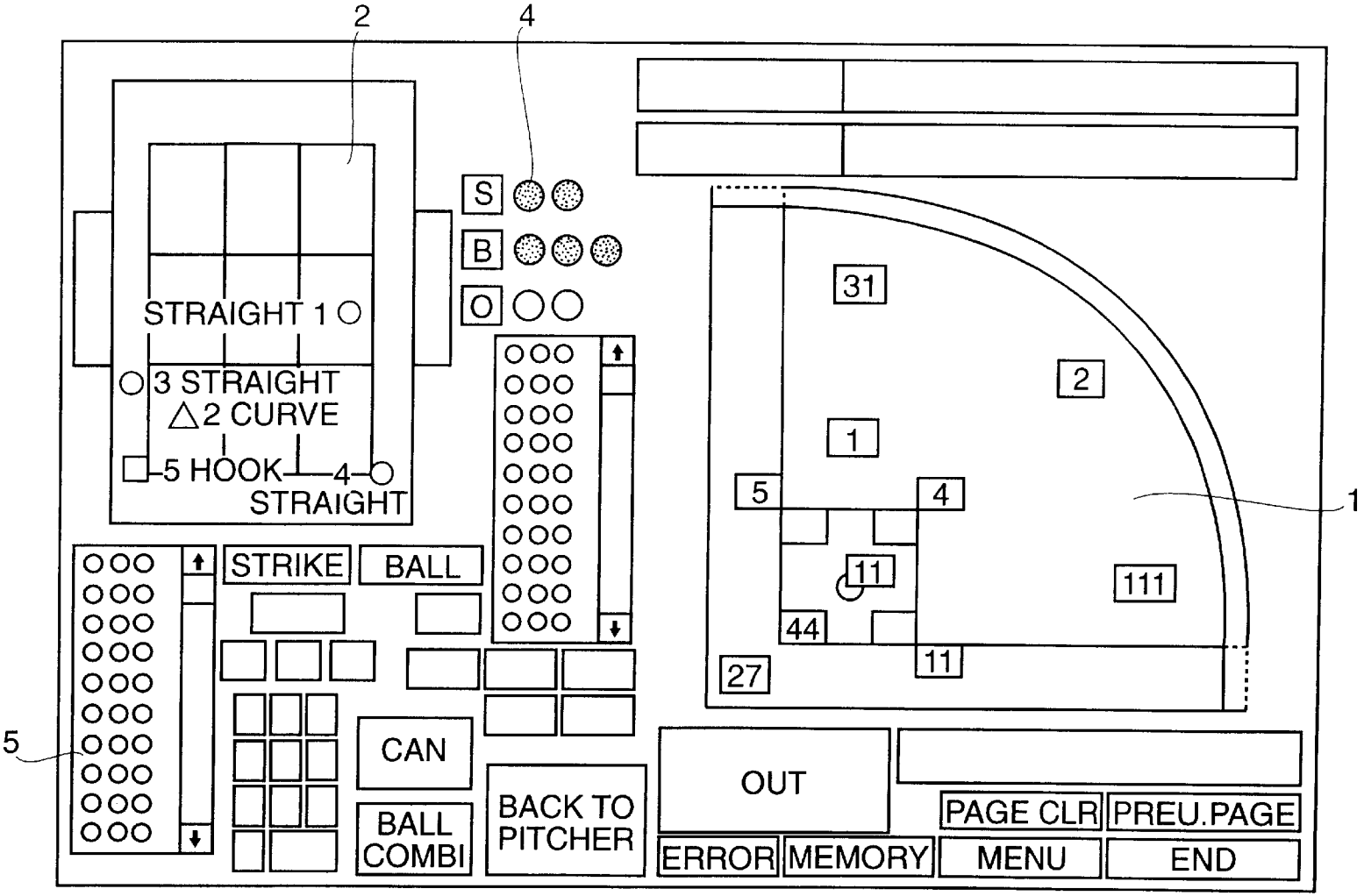
FIG. 3 shows a view of menu screen I showing a current game to be displayed on a monitor display, wherein the current game is at the first inning, a ball count is at two strikes and three balls, and a pitcher has a ball in hand.

FIG. 3 shows a means for inputting through the menu screen I. That is, the team scorer has a touch pen in hand and sits face to face with the monitor display while he watches a baseball game in progress, live or on television.

According to FIG. 3, when a pitcher has a ball in hand in the diamond, the pitcher on the monitor display is marked with a circle. In each square of defensive positions, the uniform number of each player can be indicated. Moreover, in each square of the first, second and third bases, the uniform numbers of each runner in a team up at bat can be indicated.

For example, when a pitcher throws the first ball against a batter and the batter ignores the first ball, the team scorer clicks the first ball distribution in a strike zone table on the monitor display with the touch pen C. When the kind of ball is a straight ball, the team scorer clicks the character for a straight in the pitched ball type indicator with the touch pen C. Accordingly, the team scorer can know that the first ball is a straight ball and a point where the first ball is distributed. Then, when the team scorer clicks the character for a strike in the strike and ball indicator 8, a circle with "S" in the strike, ball and out indicator 4 will be illuminated. As the game progresses, the team scorer can input data repeatedly while a batter stands at bat.

Another example, when the batter with uniform number 44 gets a three-base hit after the ball count is two strikes and three balls, the team scorer clicks on a third base in the diamond table 1 on the monitor display A and then a line where the batter ran is drawn automatically from the home base to the third base and the uniform number 44 is indicated in a square of the third base.

Next, the team scorer clicks on the point where the batted ball is caught by a fielder or reaches the stands and then a straight line is drawn automatically from the home base to the inputted point.

Figure 4:
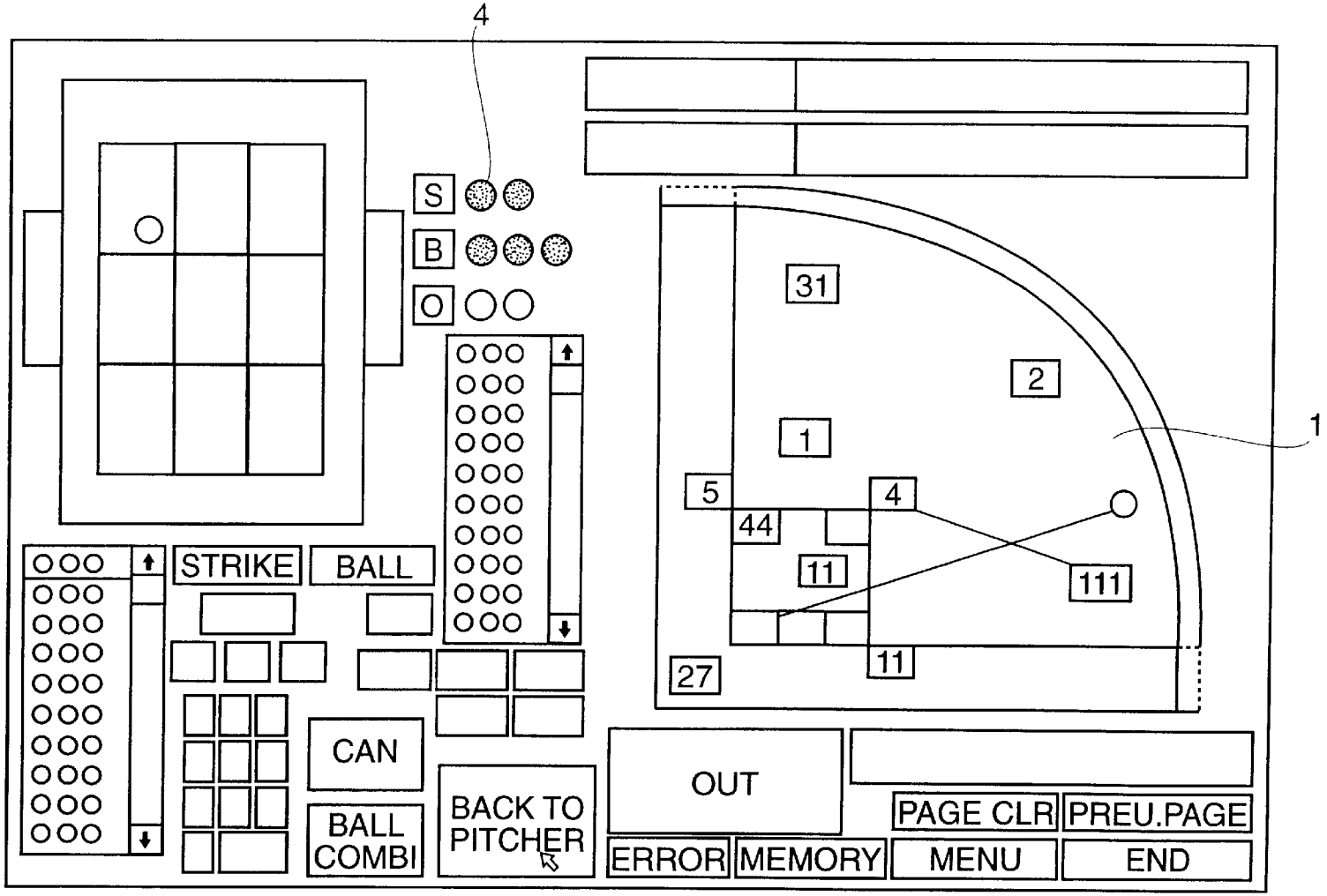
FIG. 4 shows a view of menu screen I showing a current game to be displayed on a monitor display, wherein the current game is at a first inning and a batter gets a third base hit after a ball count of two strikes and three balls.

Moreover, the team scorer clicks on a fielder who caught the batted ball and another fielder who cut back the ball, the ball line is drawn on the diamond diagram 1, as shown in FIG. 4. When the returning ball comes back directly from the outfield to the home base, the line may be drawn.

Figure 5:
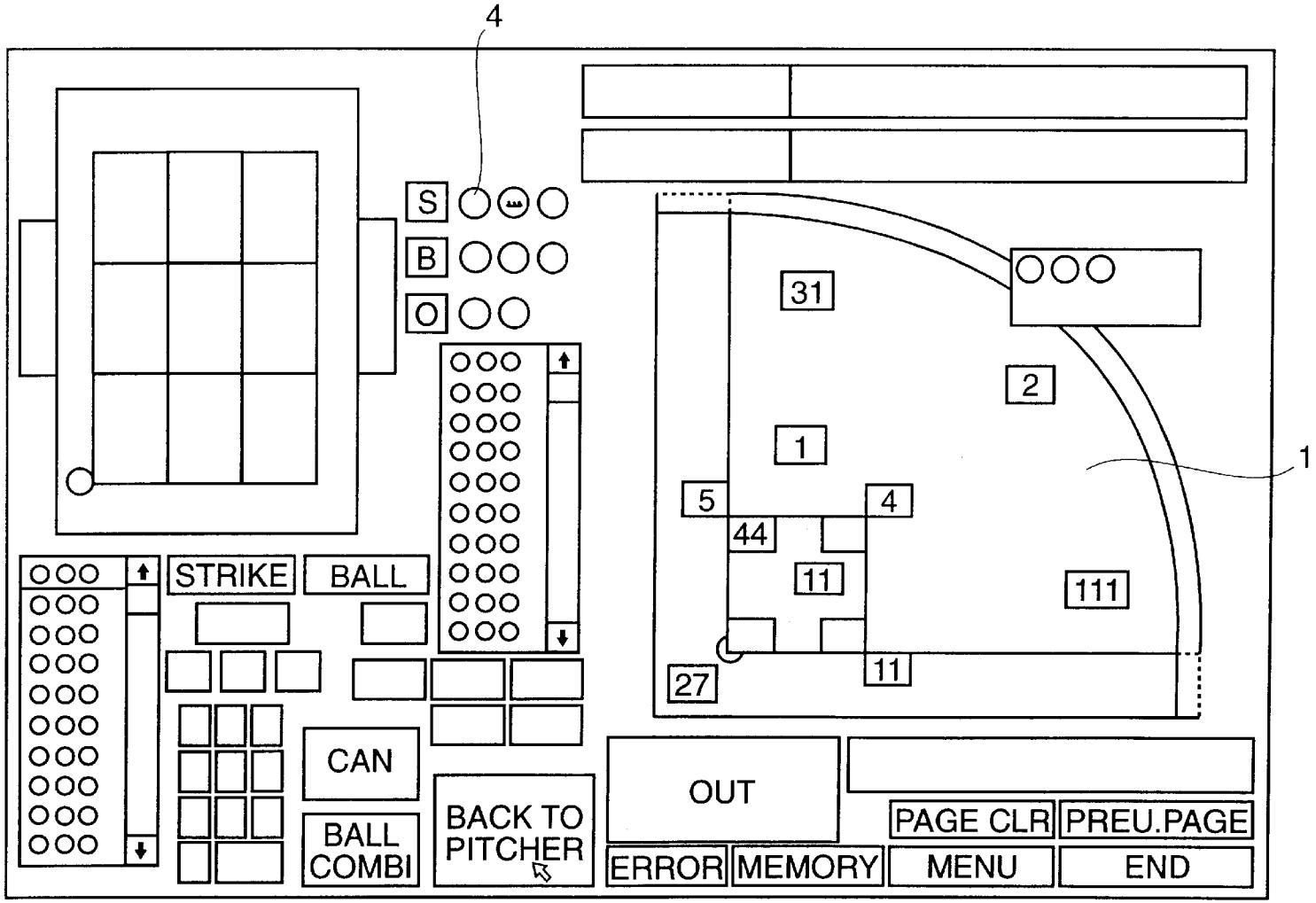
FIG. 5 is a view of menu screen I showing input means for inputting current game data to be displayed on a display, wherein a batter has struck out.
Figure 6:
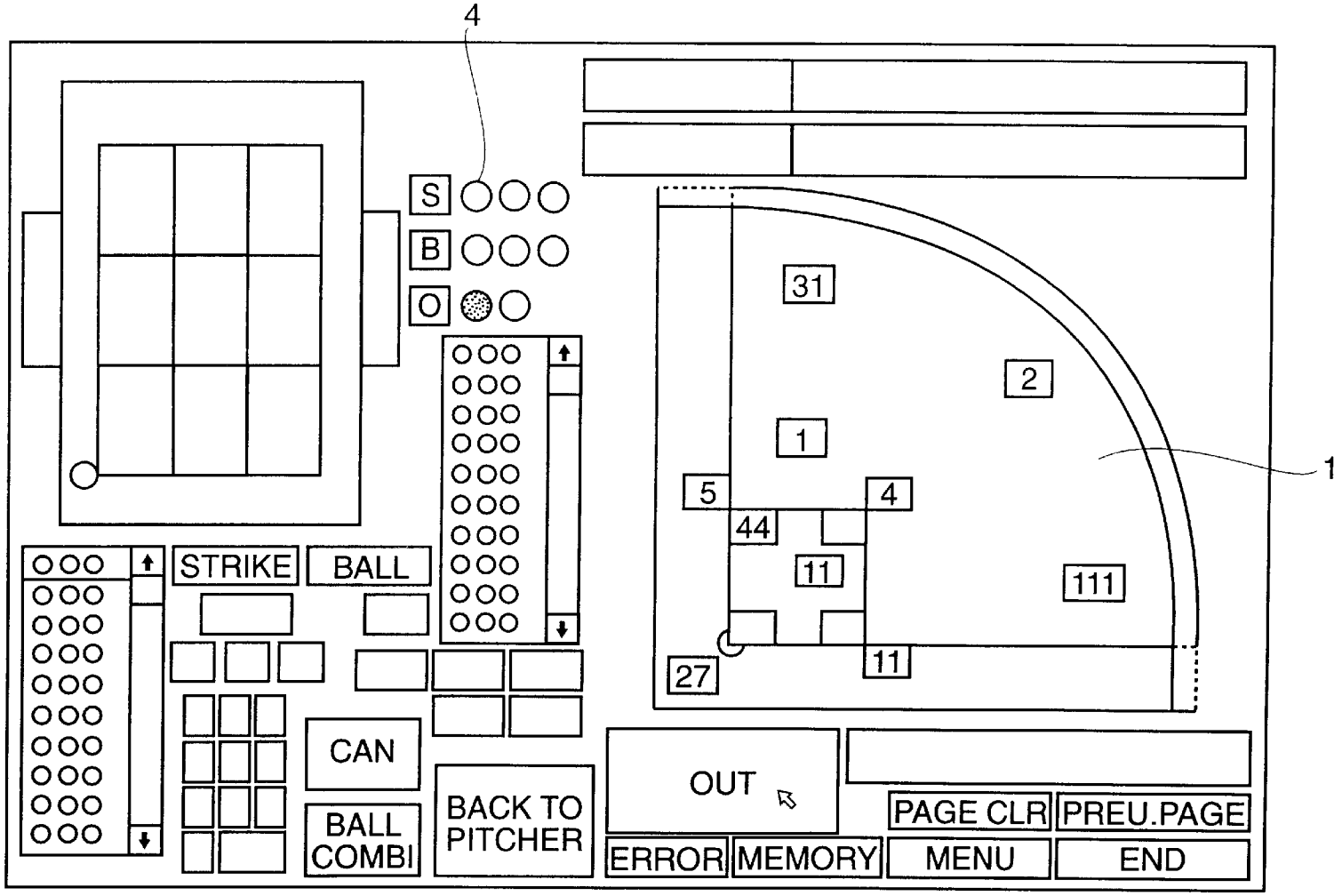
FIG. 6 is a view of menu screen I showing input means for inputting current game data to be displayed on a display, wherein a batter is striking out with one already out.

FIGS. 5 and 6 show that a batter of uniform number 0 struck out after a ball count of two strikes and two balls with a runner on third base. The strike, ball and out indicator 4 lights three circle of "S", differing from the scoreboard in the baseball stadium.

Figure 7:
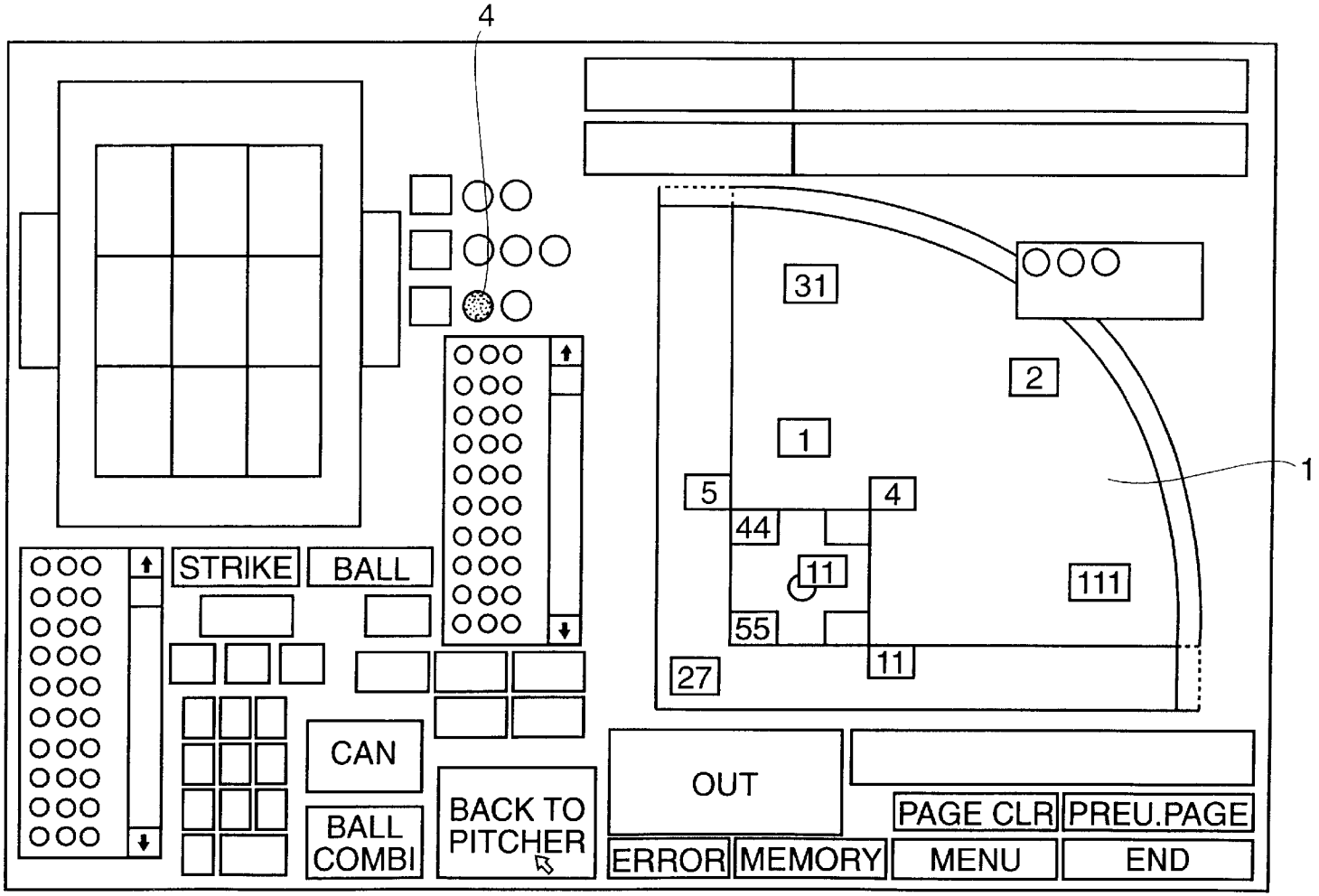
FIG. 7 is a view of menu screen I showing input means for inputting current game data to be displayed on a display, wherein an inning has ended with 0 score.

FIG. 7 shows that the next batter at bat after uniform number 0 is uniform number 55.

Figure 8:
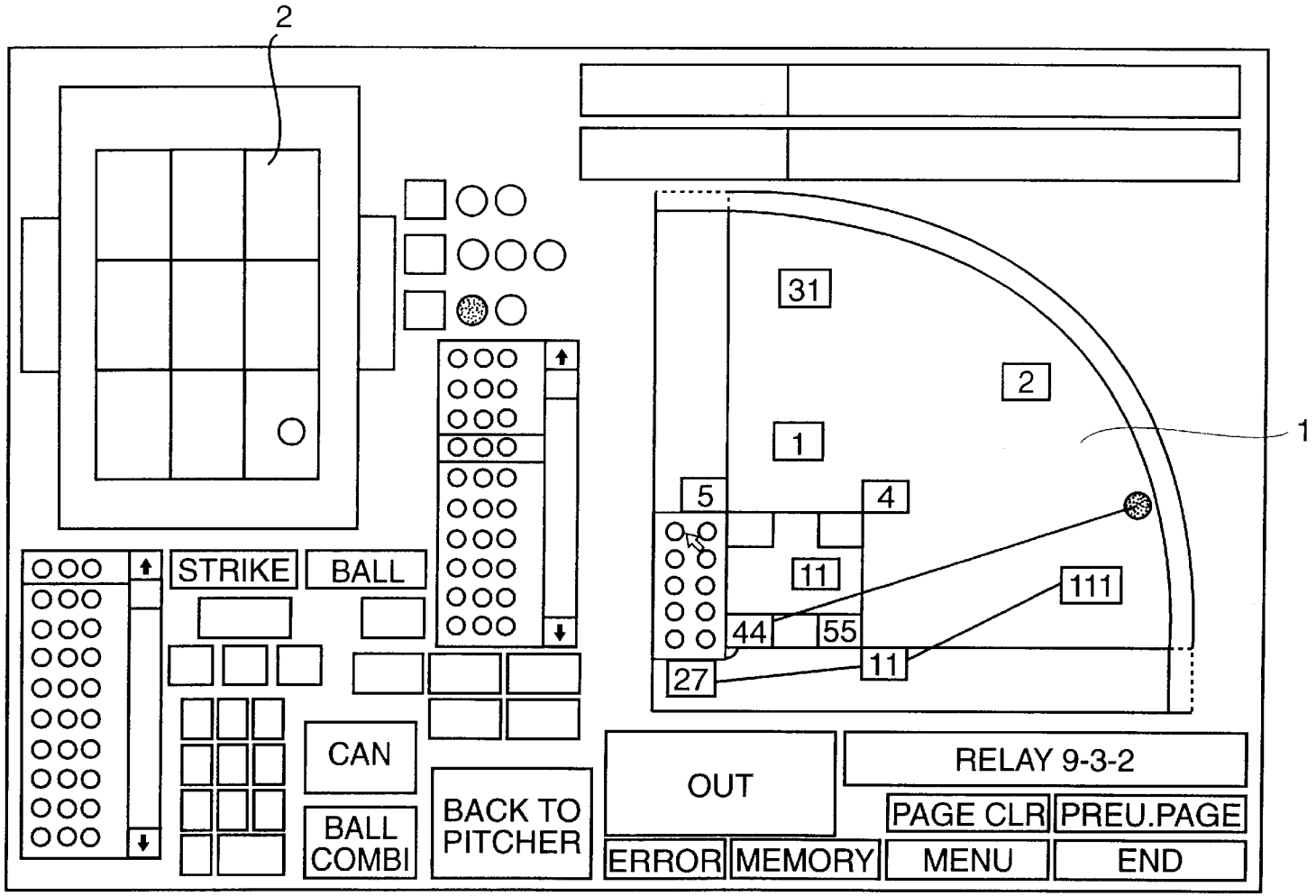
FIG. 8 is a view of menu screen I showing input means for inputting current game data to be displayed on a display, wherein a batter has made a base hit.

FIG. 8 shows that, when the batter of uniform number 55 gets a first-base hit, his batted ball grounded between the right and center fielders and the runner of uniform number 44 ran from the third base to home plate. As such, uniform number 44 is indicated in the square of home plate. At that time, it can be understood that the batted ball was caught by the right fielder and returned through the first fielder to the catcher, because "relay 9-3-2" is indicated in a caught ball order indicator.

Figure 9:
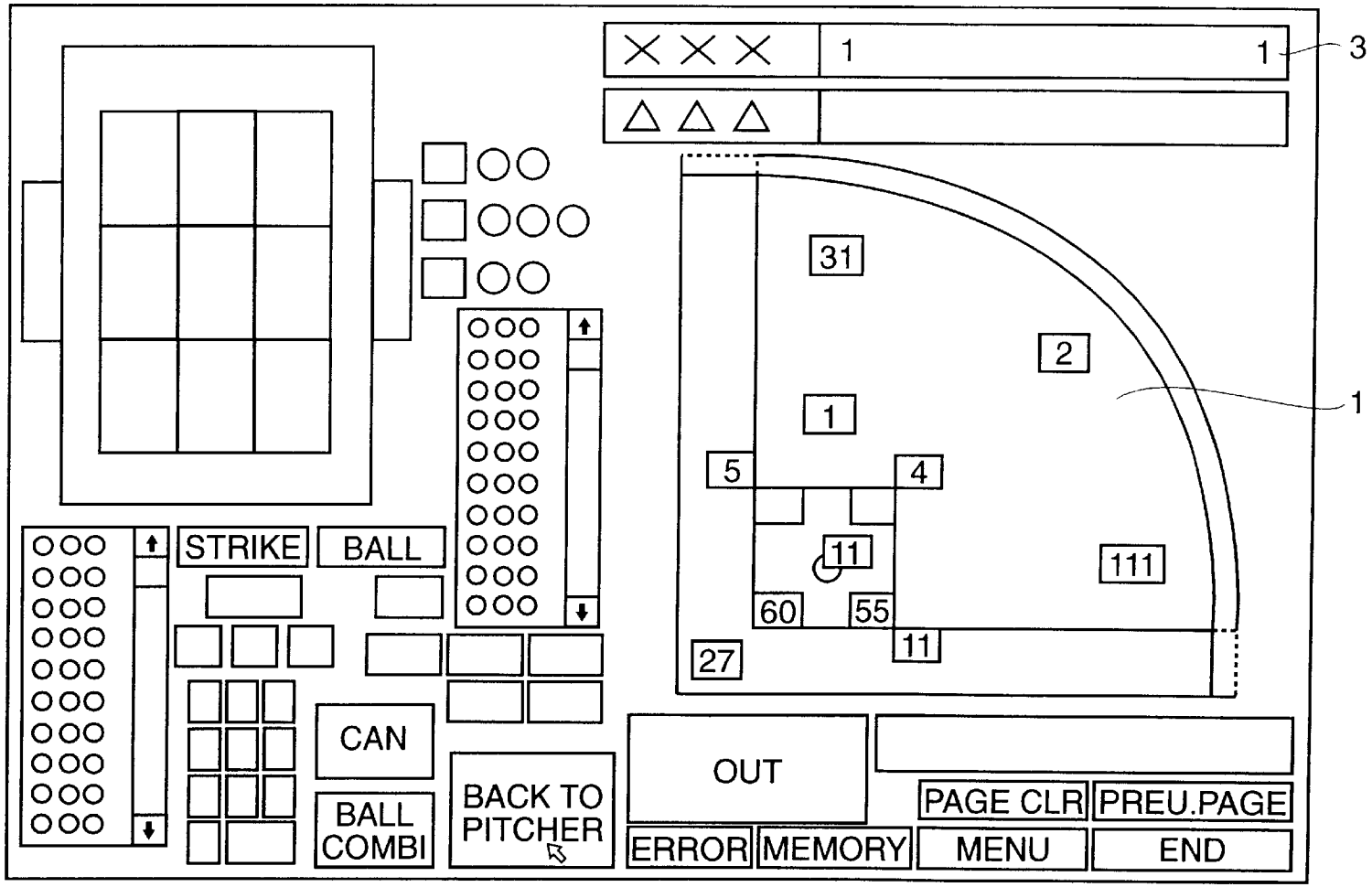
FIG. 9 is a view of menu screen I showing input means for inputting current game data to be displayed on a display, wherein the team up at bat gets 1 point.

According to FIG. 9, "1" point is indicated in the scoreboard at the top of the first inning with the team at bat of XXX. It can be understood that a batter of uniform number 60 stood at bat after the batter of uniform number 55 and got a first base-hit because uniform numbers 60 and 44 are indicated in the square of the home plate and first base, respectively.

Therefore, a team scorer can get all the information on a baseball game from game start to game finish, based on the pitching combination of the pitcher or tactics of the batters.

In the preferred embodiment, a picture is recorded by a video cassette recorder I and video camera J, linked with the touch pen board D. When the pitcher, batter, or team scorer wishes to review the recorded game or prepare for a future game, the tape cassette recorder I and touch pen board D are connected to the personal computer B to output the recorded picture and input data.

Figure 10:
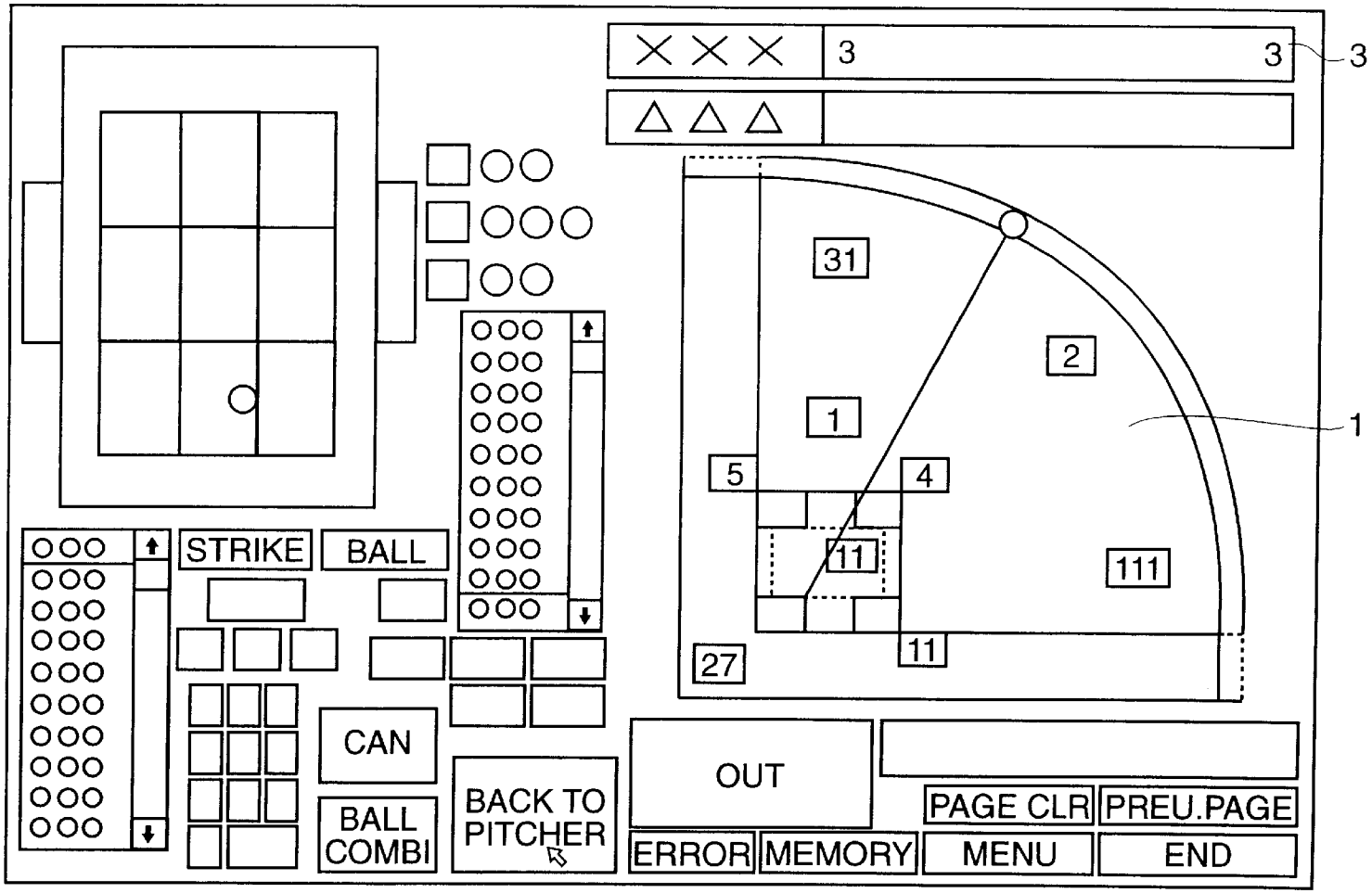
FIG. 10 is a view of menu screen I showing input means for inputting current game data to be displayed on a display, wherein a batter on the team that is up at bat hits a home run and the team gets 3 points.

Other figures besides FIG. 10 show an output means.

Figure 11:
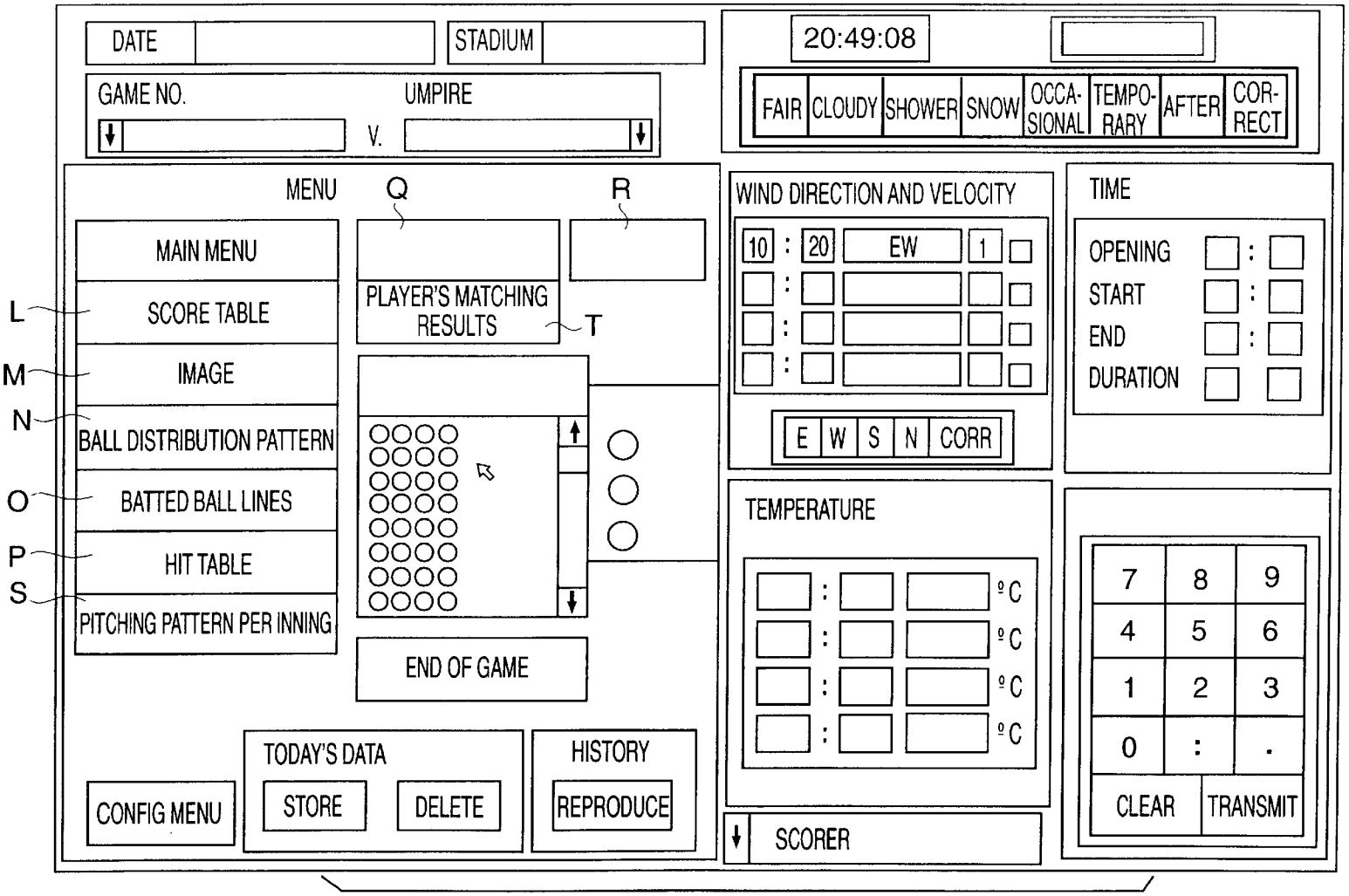
FIG. 11 is an explanatory view of menu screen II to be displayed on a display.

The personal computer B also has a program for starting and displaying a menu screen II, depicted in FIG. 11, reading all the data transferred from the touch pen board D.

The menu screen II indicates keys for showing the date, stadium name, game number, chief umpire's name, other team's name, weather conditions, start time, final time, and direction and velocity of the wind, as well as keys for displaying screens of the score table L, image M, ball distribution pattern N, batted ball lines O, hit table P, ball distribution pattern for left and right batters Q, career matching with opponent teams R and individual results matching T.

Figure 16:
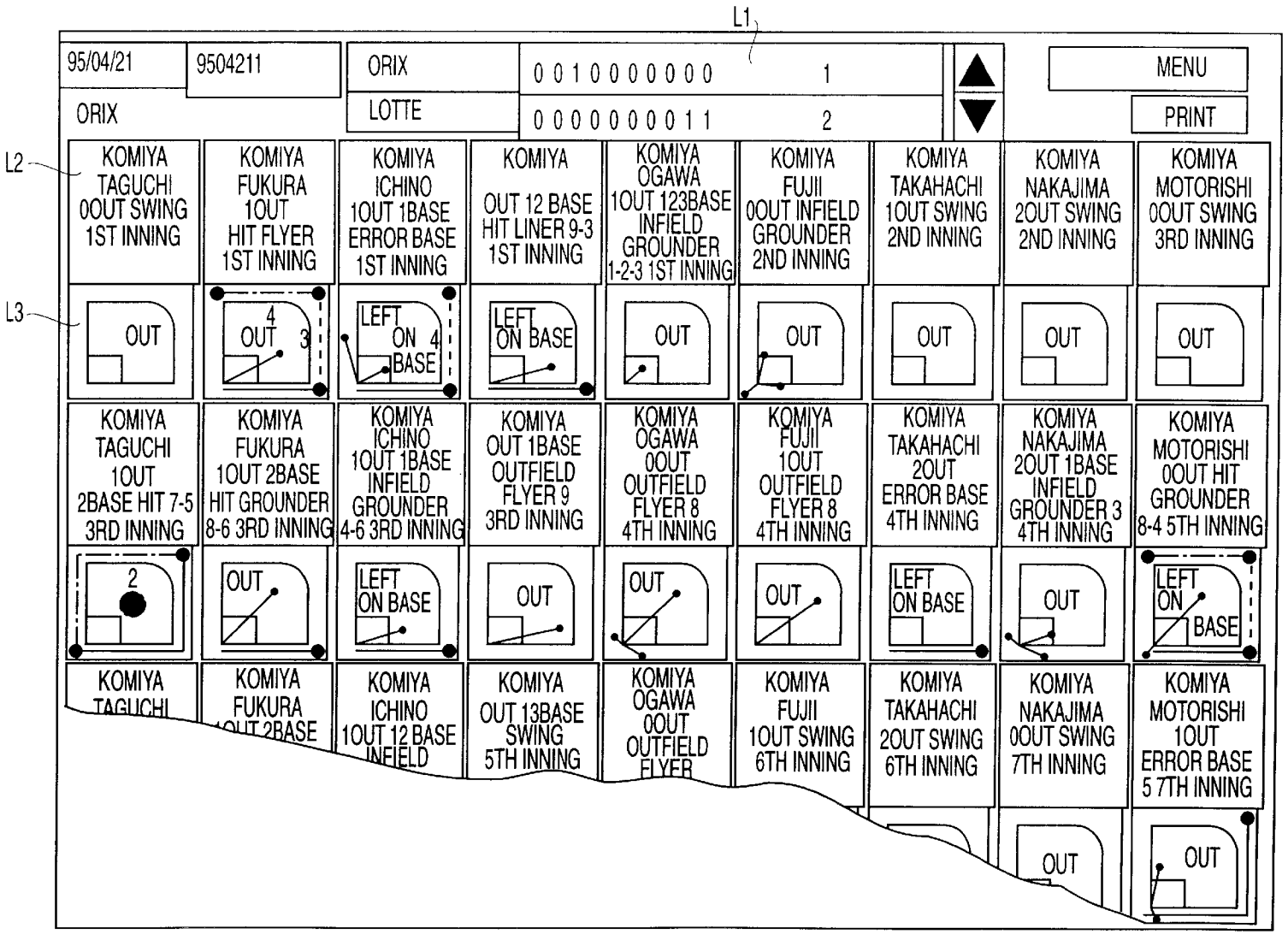
FIG. 16 is an explanatory view of a score table to be displayed on a display.

When the score table is clicked on, all the data on the score table is detected and processed for displaying a screen on the monitor display, depicted in FIG. 16.

According to FIG. 16, a scoreboard L1 is indicated at the top part of the screen and a player's name indicator for indicating the names of 1 to 9 batters in batting order. The other team's pitcher L2 and a diamond table L3 are indicated in first and second lines under the scoreboard, respectively. Continuously, the name L2 and the diamond table L3 are indicated in two lines, the names L2 in an upper line and the diamond table L3 on a lower line.

This example shows a game wherein the team from LOTTE is matched with the team from ORIX. According to the player's name indicator L2, LOTTE's starting pitcher was Komiyama and ORIX's first batter was Taguchi who struck out. Therefore, an "out" is indicated in the diamond table and "one out" is indicated in the player's name indicator of ORIX's second batter, Fukura.

For example, if the team scorer or the above batter, Taguchi, would like to see an image for displaying the pitching form of the pitcher with which he struck out, he clicks on the image M and the score table diagram L in the menu screen II. Then, a signal from the personal computer B is converted to an image signal through the converter E, transmitted to the video cassette recorder F and the image is edited in the controller G and displayed in the monitor display A. Therefore, the image is displayed in the form of dynamic and still pictures.

For example, if the above batter was struck out swinging at a straight ball thrown by the above pitcher, the batter can get information on the pitcher's motions and habits. Therefore, the batter will know beforehand when the pitcher throws a straight ball the next time they play, and he will have an advantage over the pitcher.

Figure 12:
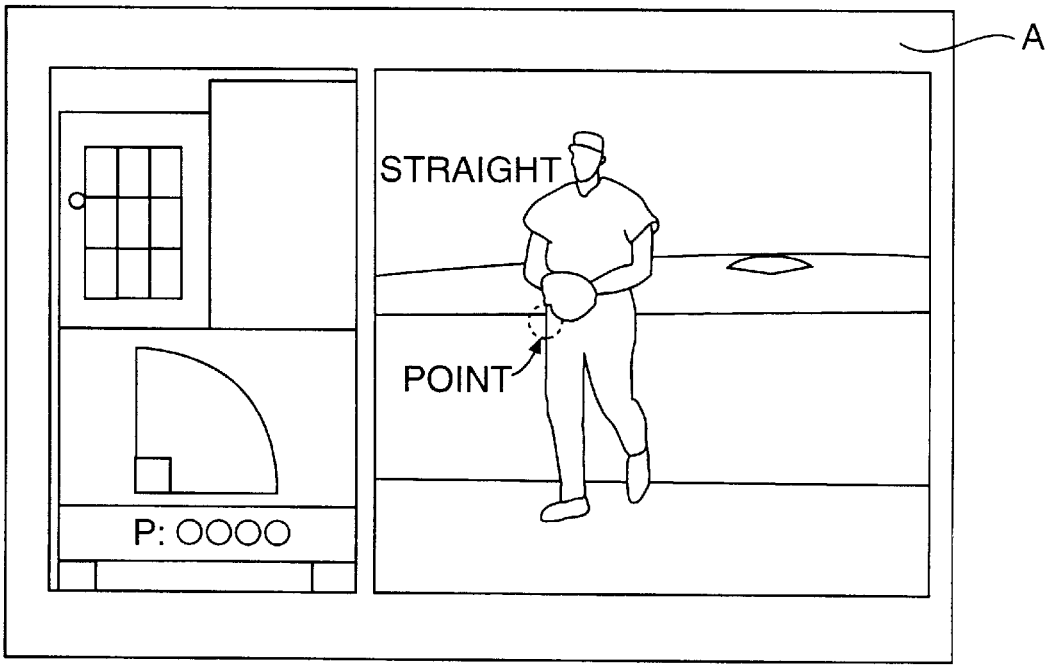
FIG. 12 is an explanatory view of a pitcher's image to be displayed on a display, wherein a first pitching motion/position of a pitcher is shown.

FIG. 12 shows an image of a pitcher starting his pitching motion. From the image, the team scorer or batter will know that, for example, when the pitcher throws a straight ball, the pitcher moves his back with a particular posture. The team scorer or batter may fill the important description in the image through the image processor.

Figure 13:
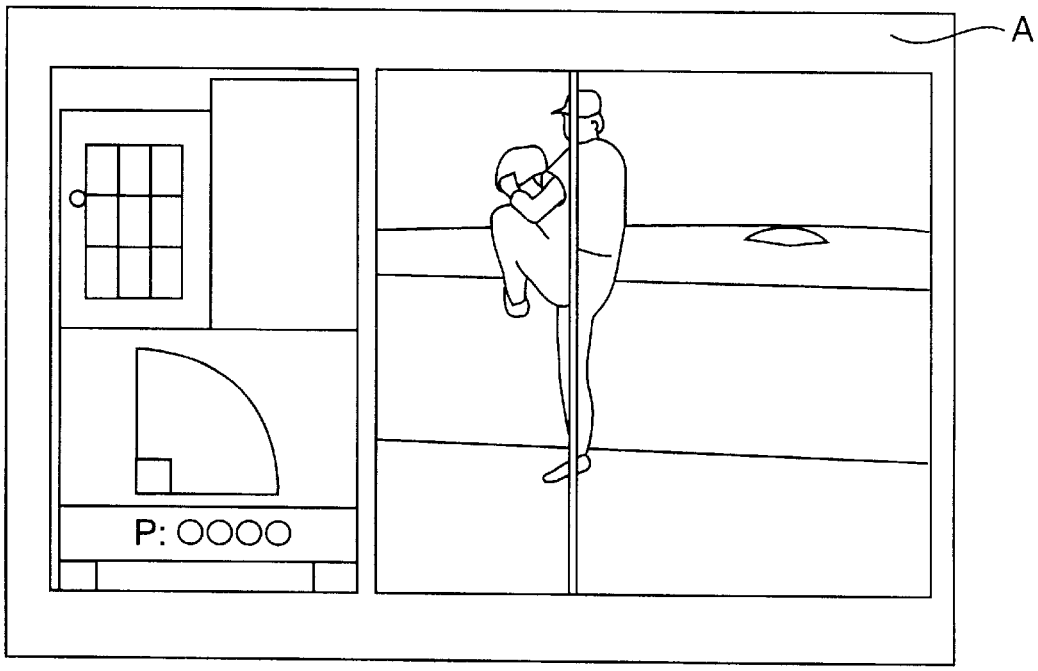
FIG. 13 is an explanatory view of a pitcher's image to be displayed on a display, wherein a pitcher's pitching motion involves raising his leg for throwing a ball.
Figure 14:
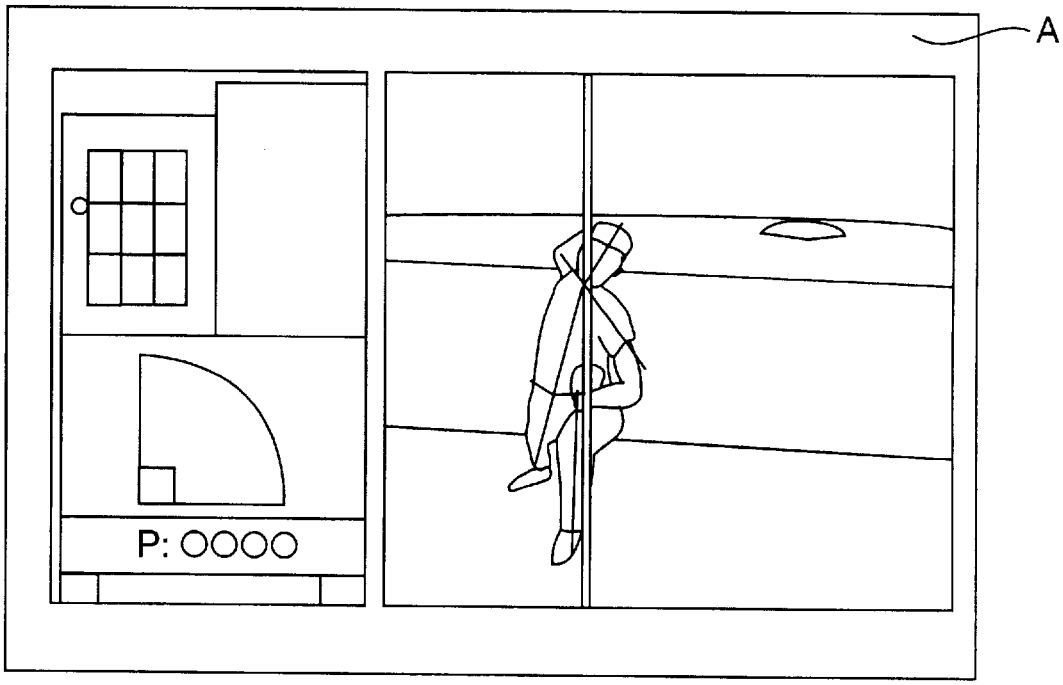
FIG. 14 is an explanatory view of a pitcher's image to be displayed on a display, wherein a pitcher's pitching motion involves raising his arm for throwing a ball.
Figure 15:
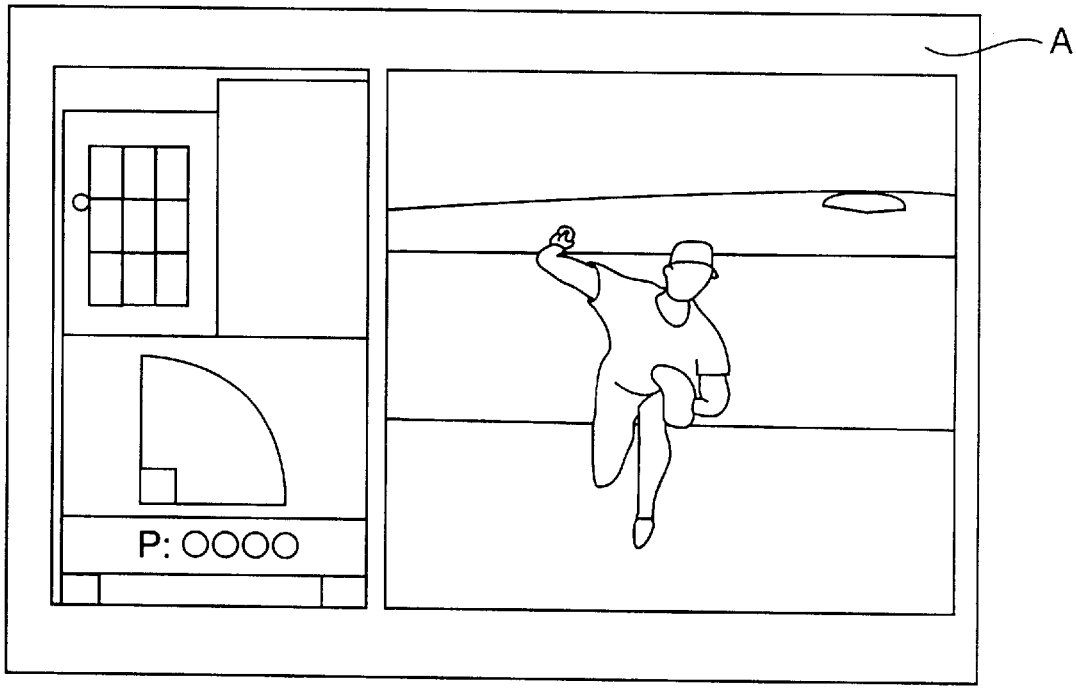
FIG. 15 is an explanatory view of a pitcher's image to be displayed on a display, wherein a pitcher's pitching motion involves the instance of throwing a ball.

Furthermore, the team scorer or batter will also get information on the pitcher's motions and habits from images of the pitcher in his pitching motion, raising his leg, and trying to throw a ball from his palm, as depicted in FIGS. 13, 14, and 15, respectively, and match with the pitcher in a future game using that important data.

Conversely, the pitcher can change his motion by getting information on his pitching motions and habits for when he matches with the batter in a future game.

The ball distribution pattern N by the pitcher is displayed when the ball distribution pattern N in the menu screen II is clicked. The ball distribution pattern N can be displayed in only the first inning or all innings of the baseball game when the inning numbers are clicked through the number keys (N1).

Figure 17:
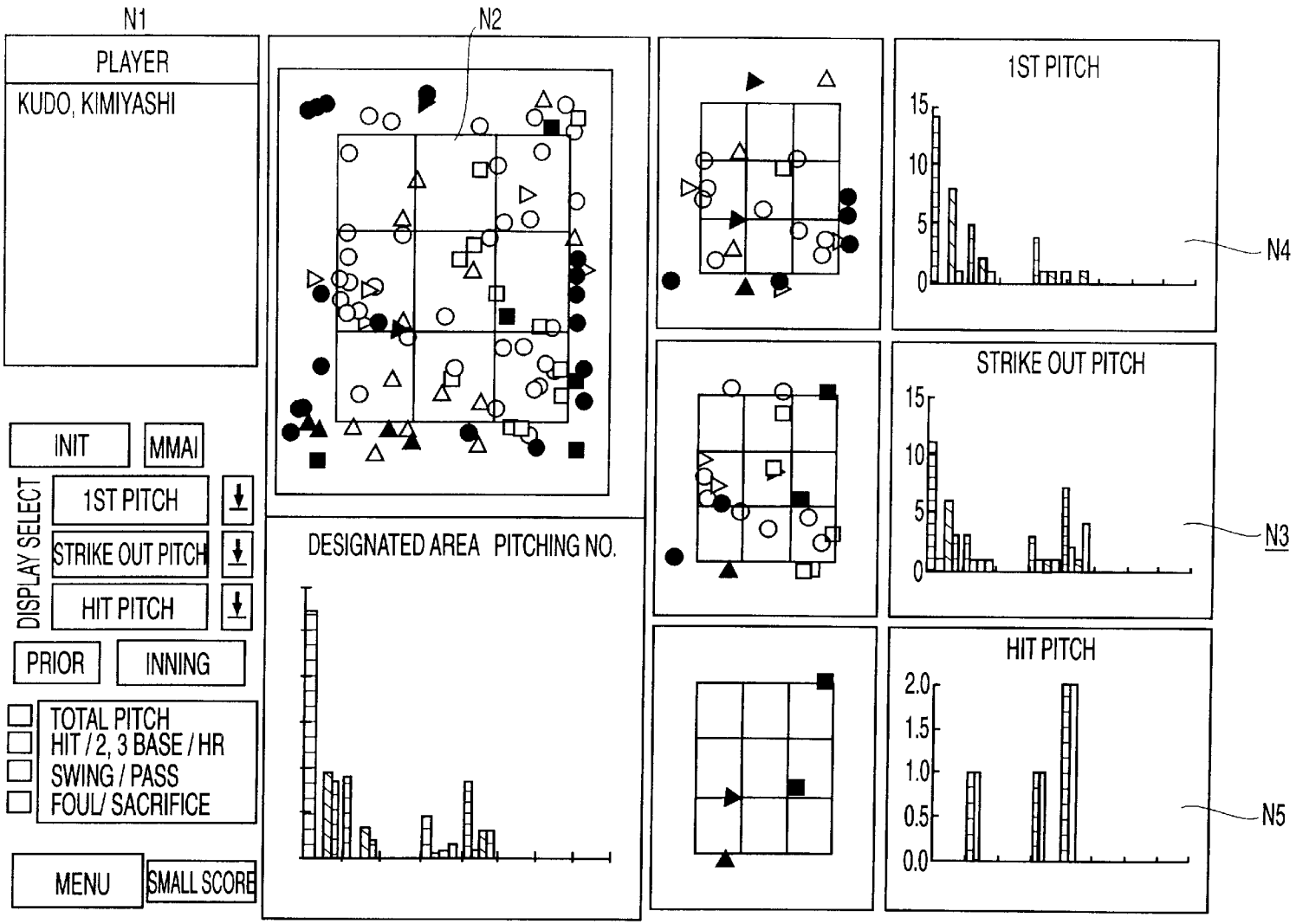
FIG. 17 is an explanatory view of a pitched ball distribution pattern to be displayed on a display.

As a result, a screen, as depicted in FIG. 17, is displayed in the monitor display A after the above desired data is detected. According to FIG. 17, a pitcher name indicator is indicated at the upper left, a strike zone table N2 is indicated and a bar graph N4 is indicated for showing the kind of pitch and tendency of the ball distribution, according to the strike zone table N2, and a bar graph N5 is indicated for showing the kind of pitch and the area of the pitch where the batter got hits. In order to show a kind of pitch and tendency of the pitched ball distribution, a circle graph may be used in place of the bar graph. Different kinds of pitches may be distinguished by using different colors or symbols. For example, straight, curve and slider balls are defined as ○, Δ, and □, respectively.

Accordingly, the scorer or batter will know that the pitcher threw straight balls frequently, as a ratio, or that the pitcher's curve ball pitch was called a ball frequently, or that when the pitcher threw his first ball, his ball was often straight, whereby the batter will know to bat the pitcher's first ball aggressively, or that when the pitcher threw his winning shot at the strike two and ball three, he threw his straight ball outside of the strike zone, etc.

Conversely, the scorer or pitcher will know with what kind of pitch the batter gets long and single hits. For example, it can be understood from N9 that when the pitcher threw a fork ball pitch, he was hit frequently. Therefore, the scorer, batter or pitcher will be able to get the necessary information prior to that kind of pitch being used or encountered again.

Furthermore, the pitcher will know his weak points so that when he throws his pitches he will change his pitching form.

Next, if the team scorer or pitcher would like to know the distribution pattern of the batted ball by the batter, he can click on the distributing pattern for batted balls in the menu screen II.

Figure 18:
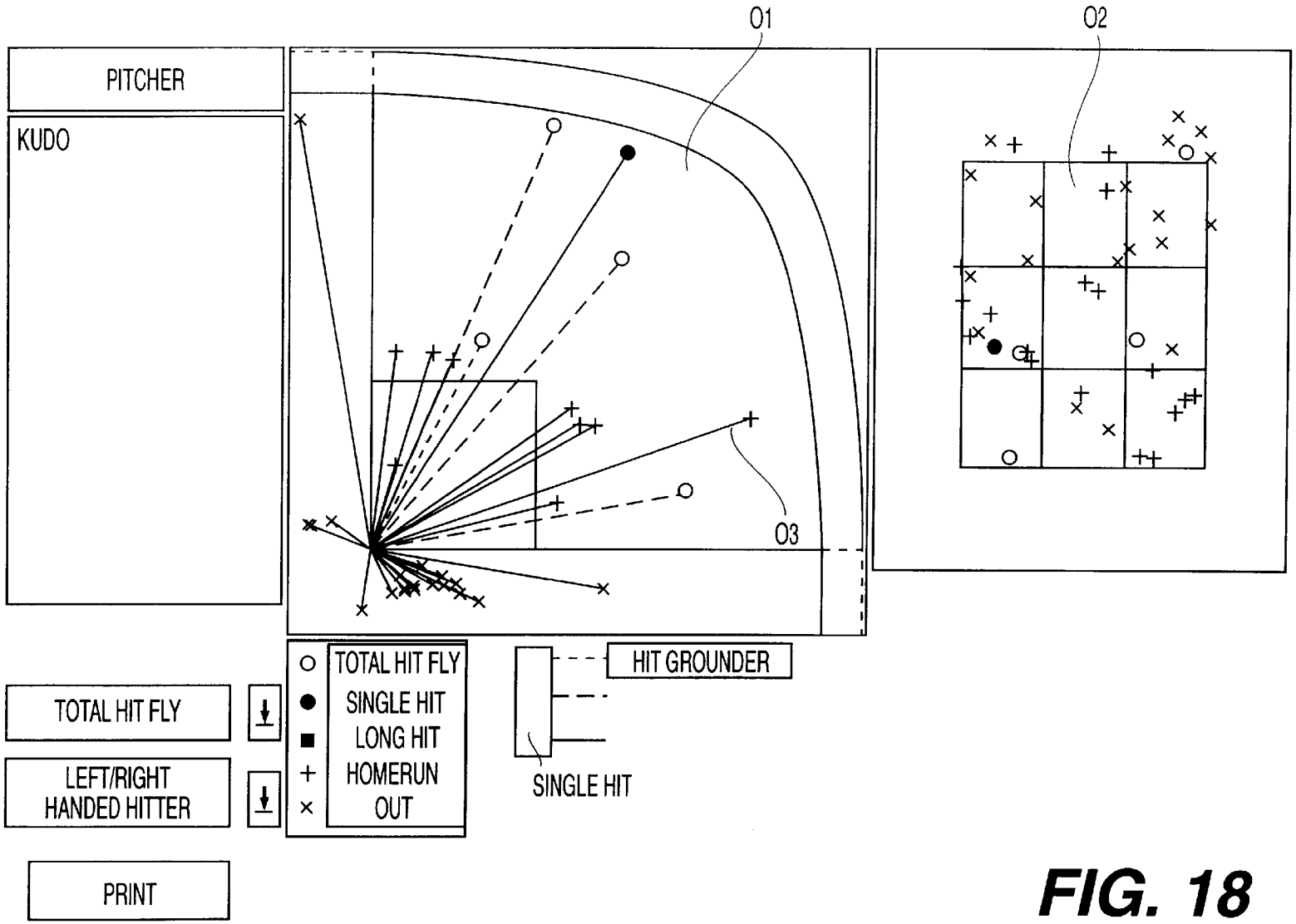
FIG. 18 is an explanatory view of a batted ball distribution pattern to be displayed on a display.

Accordingly, as depicted in FIG. 18, a diamond table for the distribution pattern for batted balls in inning data 01, and a strike zone for showing the ball distribution and result 02 are indicated. The batted ball line 03 is indicated in the diamond diagram 01. If the batter was out, the point of the ball line is indicated as X. If the batter got a hit, the point of the ball line is indicated as ○, and if the batter got a home run, the point of the ball line is indicated as ●. Then the result of the batted ball may be indicated in the strike zone 02 with the same symbols as the point of the batted ball. That is, the batter will know in which directions he hit the balls, in order to get home-runs.

Next, when the hit table P in the menu screen II is clicked on, a list is simultaneously indicated on the monitor display under the input data on the current game or a past game, as shown in FIG. 19. The batter can find out which pitcher the batter had a hard time hitting, or the pitcher can find out with which batter(s) the pitcher had a hard time striking out.

Figure 20:
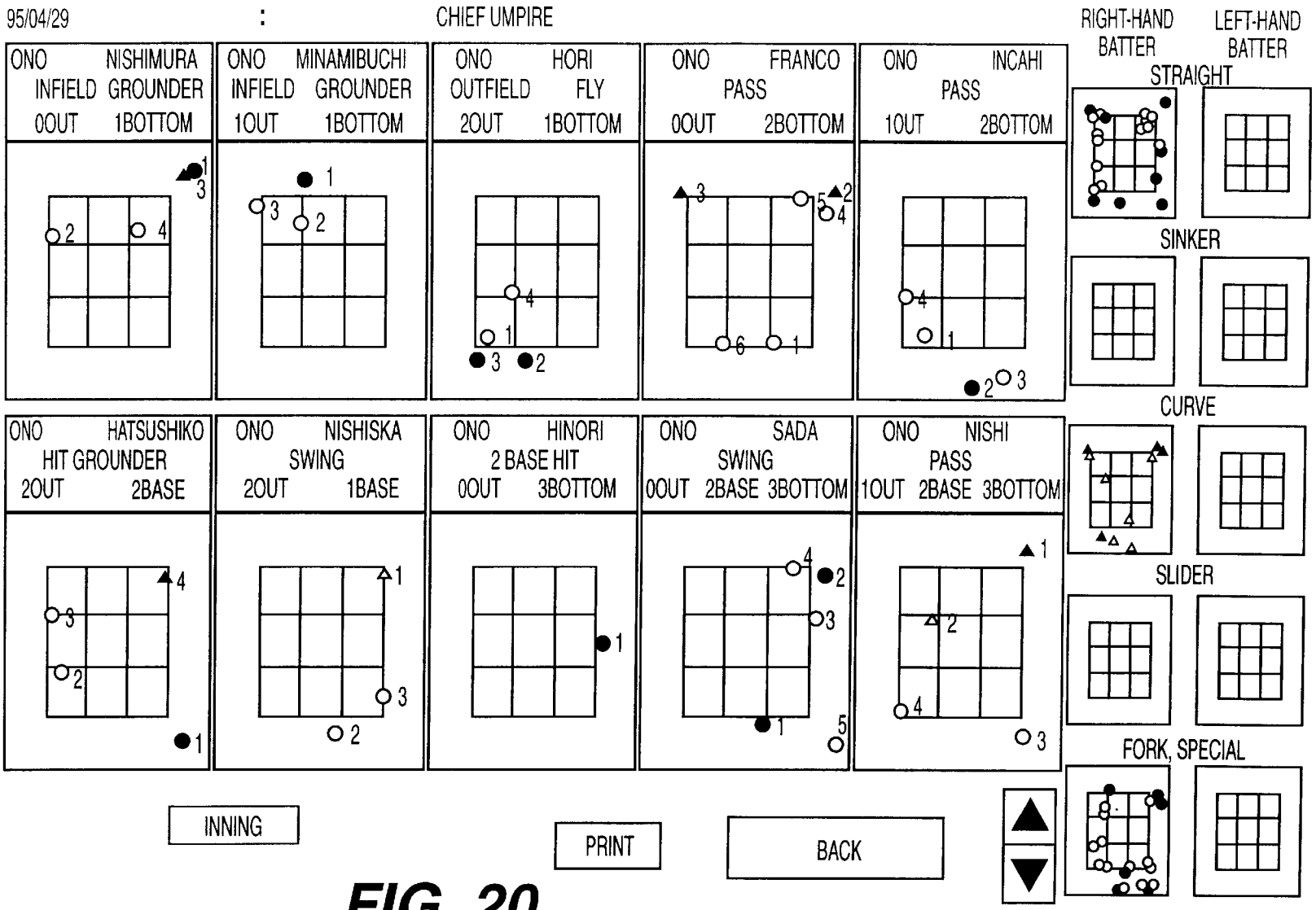
FIG. 20 is an output table of a ball distribution in each inning to be displayed on a display.

When the pitching pattern S on the menu screen II is clicked on, the data on the pitching pattern is detected, edited for each inning, and displayed on monitor display A, as depicted in FIG. 20. From that display, the batter will know what kind of pitching pattern the pitcher combines in each inning.

According to FIG. 20, a batter's name and a pitcher's name S1, a result of the match S2, and a strike zone diagram S3 are indicated. Therefore, the pitcher will know that when he threw his ball high in the strike zone, his ball was hit by batters frequently, while the batter had a hard time hitting lower balls in the strike zone. Conversely, the batter will know his own weak points.

Figure 21:
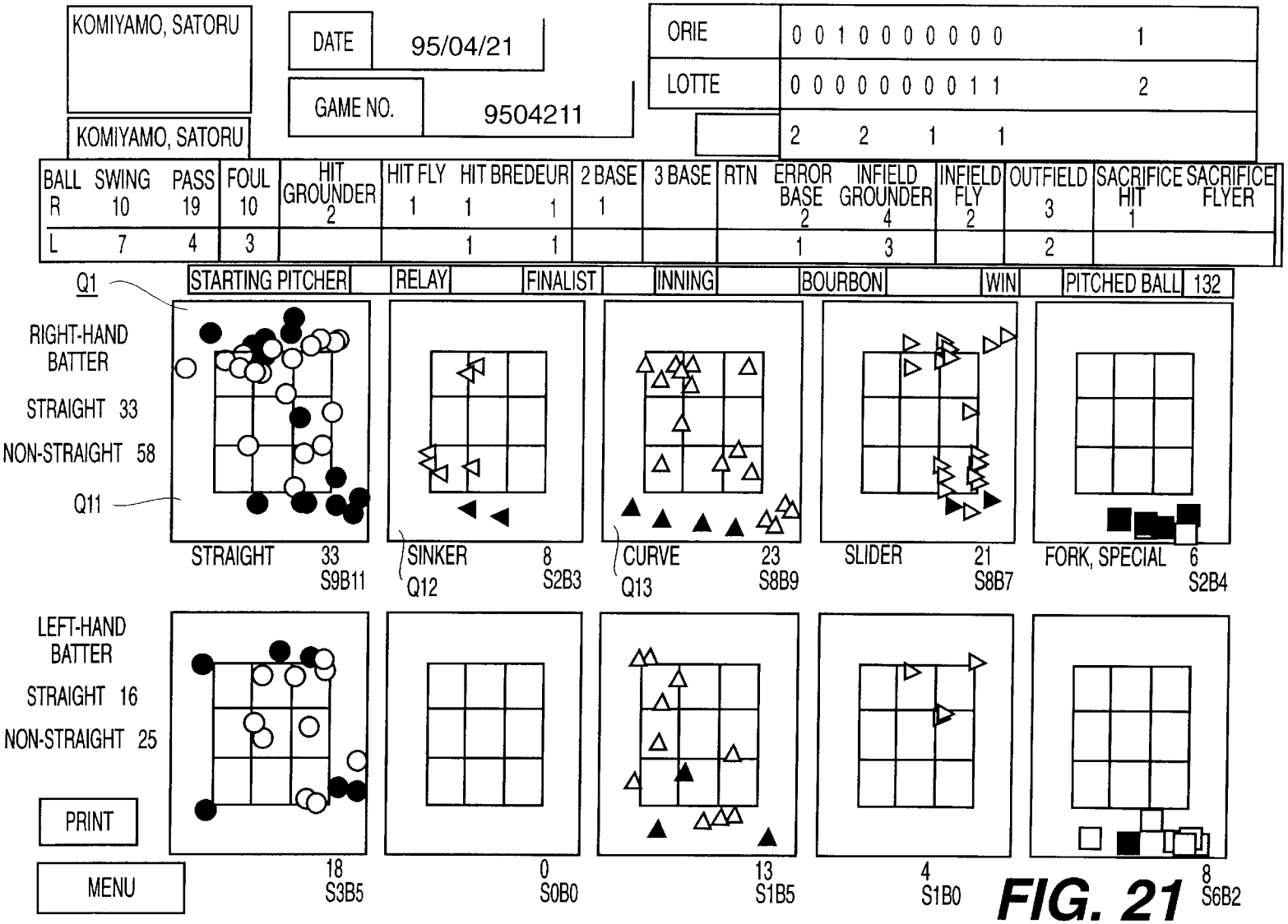
FIG. 21 is an output table of a ball distribution for left and right handed batters to be displayed on a display.

When the ball distribution by left or right-handed batters Q on the menu screen II is clicked on, a ball distribution table, classified by the kind of pitch and vertically separated between left or right-handed batters, is indicated on monitor display A, as depicted in FIG. 21.

For example, according to FIG. 21, the ball distribution table Q11 shows a pattern in which a pitcher threw straight balls against a right-handed batter. The ball distribution table Q12 shows a pattern in which a pitcher threw screw and sinker balls. Another ball distribution table Q13 shows a pattern in which a pitcher threw curve balls against right-handed batters. Other ball distribution tables show slider and fork ball patterns, for example.

Therefore, the batter, pitcher and coaching staff or manager in the baseball team will get important information. Because they will know, for example, that when a pitcher throws breaking balls, he has difficulty throwing the balls on a strike course, or the pitcher will plan his pitching training, based on the information, or the coaching staff or manager will get the most helpful coaching manual.

Figure 22:
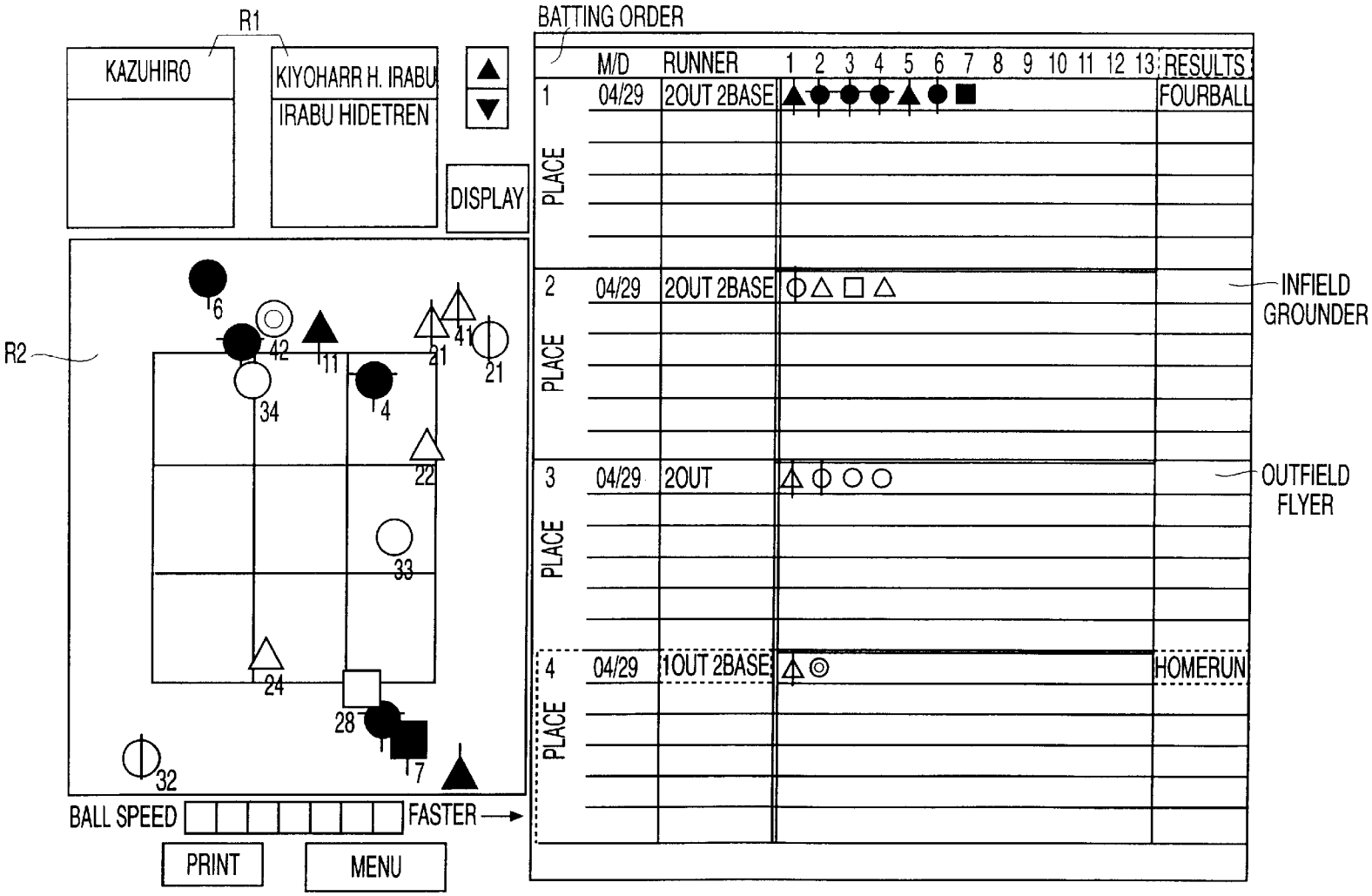
FIG. 22 is an output table of career matching between a batter and pitcher to be displayed on a display.
Figure 23:
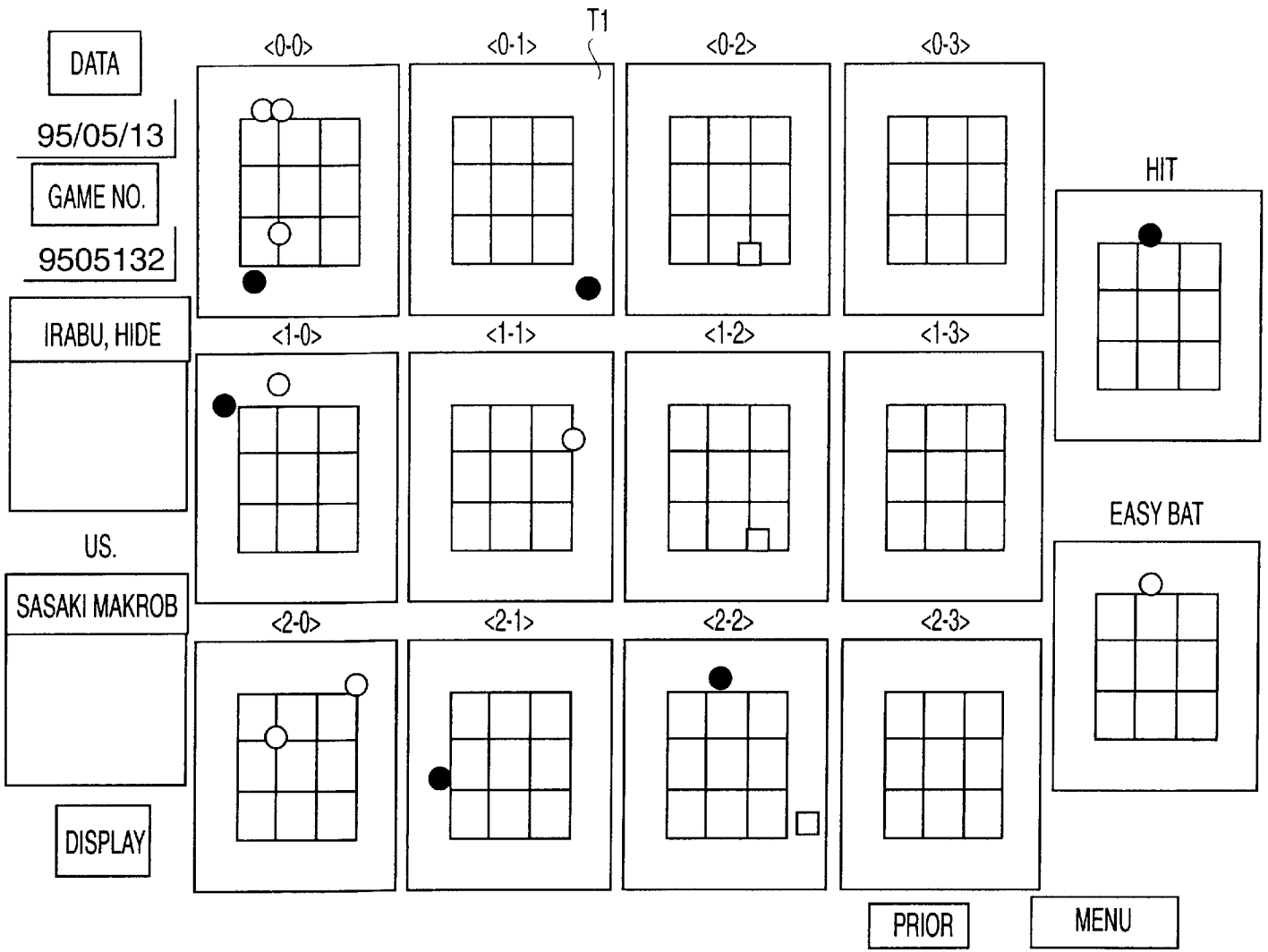
FIG. 23 is an output table of the results in matching a batter with a pitcher to be displayed on a display.

When the career matching in games R in the menu screen II is clicked on, a career table is displayed, as depicted in FIG. 22. According to FIG. 22, a name indicator matching between a batter and pitcher R1, and a ball distribution table R2 are indicated.

The ball distribution table R2 shows batting results of hits and outs, classified by colors, and swings and misses, balls, fouls, and long hits, classified by symbols of +, |, −, and@, respectively, as stated above. Therefore, the batter will know the kind of pitches with which he has gotten home-runs or base hits frequently, or when a pitcher threw balls. Also, the pitcher will know the kind of pitches he has thrown with which the batter has struck out most frequently.

Furthermore, according to FIG. 22, batting results at bat R3 are indicated. The batting results at bat R3 show a diagram of which balls indicated in the ball distribution table R2 are aligned horizontally. Therefore, the batter will know ball distribution patterns in which he was struck out by a pitcher, and the pitcher will know ball distribution patterns that were hit by a batter.

In the next step, when a result matching between players T is clicked on, a ball distribution table T1 is indicated. The ball distribution table T1 is classified by each count between a strike and ball. Therefore, the pitcher will know that a batter got out or got a hit coincidentally when the combination between ball distribution and ball counts was in a certain pattern, or the batter will know that he struck out coincidentally when the combination between ball distribution and ball counts was in a certain pattern.

According to the present invention, preferably, the automatic image editor system indicated in FIG. 1 is desired as a system to be used in this embodiment. The automatic editor system has a monitor display A to be combined with a personal computer B, a converter E, a so-called V box to be connected with a personal computer B, a playback video deck "a" to be connected with the converter E through a video line, and a recording video deck "b" to be connected with the converter E through a rank cable. The playback video deck "a" is connected to a recording video deck "b"

through an analog cable. Both monitor outputs from the playback video deck "a" and the recording video deck "b" are connected to an image board input, attached on the personal computer B.

Therefore, when the team scorer or the batter would like to see a part of an image, such as when a pitcher's throwing ball form is recorded, the image is outputted on the monitor display A or recorded onto a video tape in the recording video deck "b" after the image is outputted from the playback video deck "a" to the personal computer B and edited on the personal computer.

As stated above, necessary important data in baseball games can be inputted into a personal computer, and detected, processed, edited and, if necessary, outputted into an image. Therefore, the team scorer, batter, and pitcher on the baseball team will know important information on any baseball game. For example, the team scorer, the batter, and the pitcher will try to break their individual or team weak points when they train in training camp or before they confront other team such that their team can gain the upper hand in the next game.

What is claimed is:

1. A system for analyzing offensive and defensive actions of teams in baseball games, comprising:

means for inputting data on offensive/defensive actions to be analyzed, said offensive/defensive action data including data on individual player actions to be analyzed;

means for displaying said offensive/defensive action data including at least means for displaying graphical representations of said data on said individual player actions, and means for displaying graphical representations of game result and individual player action result data;

means for recording and playing back video images of an actual game for analysis; and means for combining at least said playing back of said video images from said recording and playing back means with said displaying of said offensive/defensive action data, whereby video images of said game are extracted and displayed in coordination with outputting and displaying of offensive/defensive action data selected for viewing.

2. A system according to claim 1, wherein said means for inputting data on offensive/ defensive actions in a baseball game to be analyzed includes data entry board with a plurality of dedicated entry areas for registering predetermined types of data.

3. A system according to claim 1, wherein said means for displaying said offensive/defensive action data further includes means for displaying a graphical representation of a baseball diamond to represent the actual to be analyzed.

4. A system according to claim 3, wherein said means for displaying said offensive/defensive action data is further for displaying said graphical representations with data on at least one of individual player positions, individual player identifications, a game start time, a game end time, opposing team names, and individual pitcher names, individual batter names and teams scores.

5. A system according to claim 3, wherein said means for displaying a graphical representation of a baseball diamond is further for displaying graphical representations of data on at least one of direction, movement and count status of pitched and batted balls, current batter status, base runner status in conjunction with said baseball diamond.

6. A system according to claim 1, wherein said means for recording and playing back video images of an actual game for analysis includes a video camera for recording video images of said game.

7. A system according to claim 6, wherein said means for recording and playing back video images includes a video camera for recording video images of at least a pitcher pitching balls during said game.

8. A system according to claim 7, wherein said combining means is further for combining at least said playing back of said video images of said pitcher pitching with said graphical representations of at least said individual player action data.

9. A system according to claim 8, wherein said means for recording and playing back video images of an actual game includes a video player device and a video recorder device, said video player device being operatively connected to output selected video image data to said computer device and said video recorder device, and said computer device being operatively connected to output display image data in conjunction with said selected video image data to said video recorder device so as to record said display image data in combination with said selected video image data.

10. A system according to claim 6, wherein said combining means is further for combining at least said playing back of said video images with said graphical representations of at least said individual player action data.

11. A system according to claim 1, wherein said combining means includes a computer device having means for processing said offensive/defensive action data inputted via said data inputting means, and means for controlling operation of said display means and said video image recording and playing back means.

12. A system according to claim 11, wherein said computer device includes a monitor display for displaying at least one said selected video image data and said display image data, and a converter device operatively connected between said computer device and said video recorder device for converting said display image data from said computer device into video display image data to be recorded in said video recorder device.

13. A system according to claim 1, wherein said data on individual player actions to be analyzed includes data on at least one of a distribution of balls pitched into a strike zone, a distribution of balls hit from a strike zone, pitches from a selected pitcher hit, pitches from a selected pitcher hit by a selected batter, hitting results of a selected batter and hitting results of a selected batter with a selected pitcher.

14. A method for analyzing offensive and defensive actions of a team in a baseball game, said method comprising the steps of:

inputting offensive/defensive action data on teams in an actual game to be analyzed;

providing video images of the actual game to be analyzed;

generating graphical representations of offensive/ defensive actions to be analyzed; and combining said graphical representations with video images of said actual game, wherein said step of generating said graphical representations includes the step generating graphical representations of data on game results and individual player action results, and said step of combining said graphical representations with said video images includes combining displaying of graphical representations of offensive/ defensive action data that are selected for viewing with displaying of selected video images related to said selected offensive/ defensive action data, whereby said selected offensive/defensive action data is viewed and analyzed in conjunction with said selected video images.

15. A method according to claim 14, wherein said step of generating said graphical representations to be analyzed further includes coordinating said inputting of data on said offensive/defensive actions with said displaying of said graphical representations.

16. A method according to claim 14, wherein said step of combining said graphical representations with said video images further includes combining said graphical representations of said data on offensive/defensive actions that are selected for viewing with displaying of selected video images related to said selected offensive/defensive action representations, whereby selected individual player action representations are viewed and analyzed in conjunction with said selected video images.

17. A method according to claim 14, wherein said step of combining said graphical representations with said video images further includes combining said graphical representations of said data on offensive/defensive actions that are selected for viewing with displaying of selected video images of a pitcher pitching, whereby selected offensive/defensive action representations are viewed and analyzed in conjunction with said selected video images of the pitcher pitching.

18. A method according to claim 14, wherein said step of generating said graphical representation further includes generating graphical representations of at least a baseball diamond of said actual game.

19. A method according to claim 18, wherein said step of generating said graphical representation further includes the steps of coordinating said inputting of data on said offensive/defensive action data and generating graphical representations of at least selected individual player actions for displaying on said baseball diamond.

20. A method according to claim 18, wherein said step of inputting offensive/defensive action data further includes the steps of inputting data on at least one of direction, movement and count status of pitched and batted balls, current batter status, base runner status and inning status, and generating graphical representations of at least said direction, movement and count status of pitched and batted balls for displaying on said baseball diamond.

21. A method according to claim 14, wherein said step of generating said graphical representation further includes generating graphical representations of data on results of at least pitching and batting actions.

* * * * *